United States Patent [19]

Van Vliet

[11] Patent Number: 4,697,357

[45] Date of Patent: Oct. 6, 1987

[54] GARMENT-DRYING NETTING PLATFORM

[76] Inventor: Art Van Vliet, 1903 NE. 130 Pl., Seattle, Wash. 98125

[21] Appl. No.: 575,300

[22] Filed: Jan. 30, 1984

[51] Int. Cl.[4] ..... F26B 9/10

[52] U.S. Cl. ..... 34/148; 34/151; 34/239

[58] Field of Search ..... 34/239, 148, 151; 108/47, 129, 149; 211/13, 180, 181, 106; 248/346

[56] References Cited

U.S. PATENT DOCUMENTS

| | | | |
|---|---|---|---|
| 1,049,596 | 1/1913 | Perkins | 211/106 |
| 1,895,323 | 1/1933 | Hauf | 211/126 |
| 2,084,854 | 6/1937 | McCarthy | 211/106 |
| 2,521,100 | 9/1950 | Sublette | 34/239 |
| 2,956,689 | 10/1960 | Van Der Togt | 211/181 |
| 3,358,388 | 12/1967 | Weiss et al. | 34/239 |
| 3,487,557 | 1/1970 | Linstead | 34/151 |

FOREIGN PATENT DOCUMENTS

| | | | |
|---|---|---|---|
| 680602 | 2/1964 | Canada | 211/181 |
| 16635 | of 1909 | United Kingdom | 34/239 |

*Primary Examiner*—Albert J. Makay
*Assistant Examiner*—David W. Westphal
*Attorney, Agent, or Firm*—Robert W. Beach; Ward Brown

[57] ABSTRACT

A clothes-drying platform composed of coarse nylon netting stretched taut between frame members knitted through the marginal courses of the netting can be supported alternatively by swingable retractable legs, by suction cups on the corners of the platform and by a suspension sling including loop legs attachable to the platform corners by being caught behind the suction cups.

3 Claims, 4 Drawing Figures

GARMENT-DRYING NETTING PLATFORM

BACKGROUND OF THE INVENTION

1. Field of the Invention

This invention relates to netting platforms useful for supporting in spread condition garments of knitted or crocheted material, such as sweaters, to be air-dried after washing.

2. Prior Art

The Sublette U.S. Pat. No. 2,521,100, issued Sep. 5, 1950, discloses a garment drier composed of two frame sections having supported thereon sheets of reticulated fabric material such as window screening fabric having relatively large openings between which garments of the knitted or crocheted type, such as sweaters, can be retained while being dried. The patent does not appear to state how the fabric material sheets are supported on the frames. The frames can be hung vertically by a hook projecting from a frame edge.

The Weiss et al. U.S. Pat. No. 3,358,388, issued Dec. 19, 1967, discloses a drying and storing frame for knit goods carrying a foraminous backing membrane in the form of nylon netting of 16 strands per inch covering a porous sheet or blanket formed of polyurethane foam which in turn is covered by a cover membrane of 26 strands per inch. After the garment has been placed on the netting back membrane, it is covered with the foam sheet or blanket instead of both sides of the garment being freely exposed to air. A hook is provided by which the frame and garment can be hung.

The Perkins U.S. Pat. No. 1,049,596, issued Jan. 7, 1913, shows a bedclothes airing device including a frame of wire bent into a rectangular form which carries a wire screen of comparatively large mesh. The individual wires of the screen are secured to the frame members 7, presumably by welding.

The McCarthy U.S. Pat. No. 2,084,854, issued Jun. 22, 1937, discloses a clothes drier having side and end members joined to form a rectangle with a screen or other reticulated material stretched between them. The screen is secured to the side members by screws which pull together marginal members at opposite sides of the screen to clamp the screen margin between such marginal members. The screen may be supported in elevated position by crossed legs. The upper end of one of such legs can be detached from the screen so that the crossed legs can be retracted into parallel positions alongside the screen.

SUMMARY OF THE INVENTION

It is a principal object of the present invention to provide a netting platform on which knitted garments can be laid for drying and which can be supported conveniently in a horizontal position raised above any surface beneath the platform so that air can circulate freely above and below the garment to dry it effectively.

Another object is to provide a frame and netting that can be integrated readily to maintain the netting taut.

A further object is to provide means for supporting the netting platform conveniently in a variety of ways depending on the particular accommodations available for supporting the platform.

The foregoing objects can be accomplished by stretching large mesh or coarse twine netting by a marginal frame of rectangular shape and providing suction cups on the corner of the frame for supporting the frame directly, folding legs as an alternative means for supporting the frame and a suspension sling or bridle having leg loops that can be caught around the suction cups for attaching the sling to the frame and detaching it from the frame quickly and easily.

DETAILED DESCRIPTION

Figure 2:
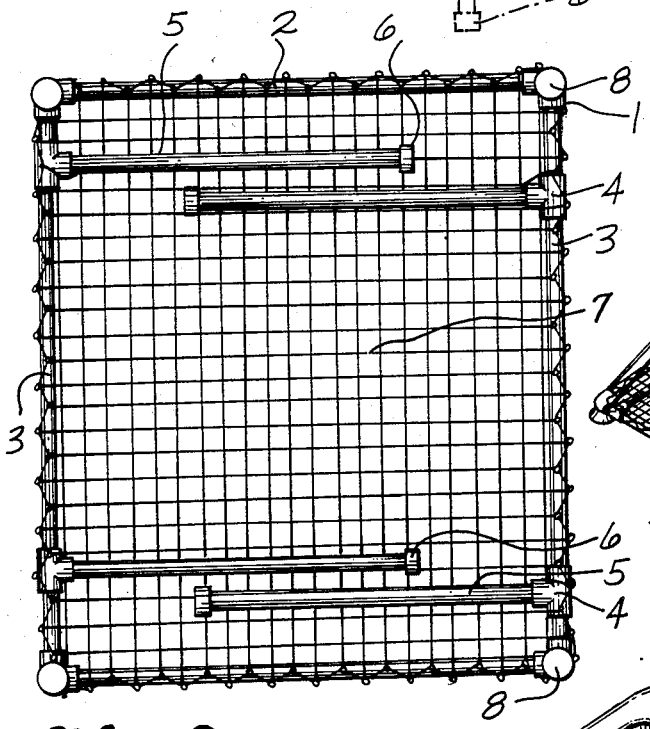
FIG. 2 is a top plan of the netting platform with parts broken away.

The frame of the platform is preferably of rectangular shape as shown in FIG. 2 and is constructed of four elbows 1 connecting the adjacent ends of straight end marginal members 2 and straight side marginal members 3. Such elbows and marginal members can all be made of round tubing of nonmetallic plastic material so as to be of light weight and rustproof while having adequate strength.

Legs that can be used to support the platform are composed of tees 4 mounted on the side marginal frame members 3 by such side members passing snugly through the through bore of the tees. The lateral bores of the tees are fitted to the ends of tubular legs 5 that can be of any length. Usually such legs will be of a length greater than one-half the length of the end marginal members 2. The tees 4 will be mounted on the opposite side members 3 adjacent to the corner elbows 1, but the tees carried by the opposite side members will be offset so that when the legs are swung into retracted positions generally coplanar with the frame 2, as shown in FIG. 2 and in solid lines in FIG. 1, the opposite legs of each pair will lie alongside each other.

Figure 1:
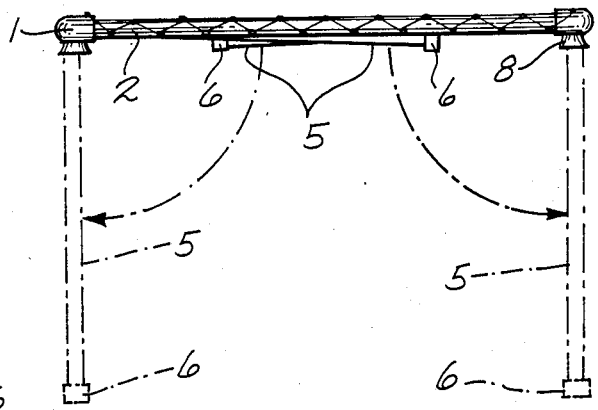
FIG. 1 is an edge elevation of the netting platform of the present invention showing legs in full lines in retracted condition and illustrating the extended condition of the legs in broken lines.

The legs carried by the opposite frame side members 3 can be swung from their parallel coplanar positions shown in FIG. 2 and in solid lines in FIG. 1, in which they are also generally coplanar with the frame, into the depending positions shown in broken lines in FIG. 2 for supporting the frame in elevated position. Boots or tips 6 may be provided on the swinging ends of the legs to close the ends of the tubular legs and protect a surface engaged by the legs from being marred by the tube ends.

The through bores of the mounting tees 4 provide sufficient purchase on the side marginal members 3 so as to minimize tilting of the legs in the planes of the side members when the legs are in their extended depending positions.

Figure 3:
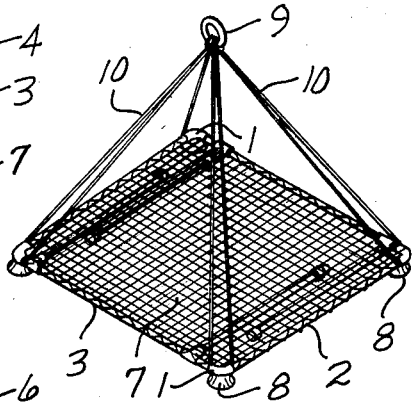
FIG. 3 is a top perspective of the netting platform shown in suspended condition.
Figure 4:
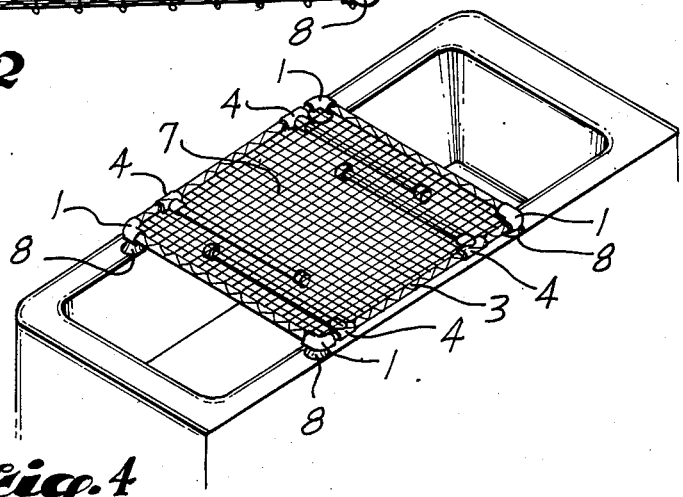
FIG. 4 is a top perspective of the netting platform shown in position spanning a bathtub.

As shown in FIGS. 2, 3 and 4, the coarse twine netting panel 7 is of large mesh so that, as shown in these figures, the width of the apertures between the strands of the netting is greater than the width of the frame end marginal members 2 and the frame side marginal members 3. The coarse netting may, for example, have a mesh of approximately one-half strand per inch, so that the widths of the net apertures are as great as two inches. Such greater width of the mesh apertures enables the side and end frame members to be braided through the marginal coarse of the netting apertures by being threaded through such marginal apertures of the netting.

The lengths of the frame end marginal members 2 and of the frame side marginal members 3 should be selected with relation to the size of the netting panel desired, so that when the frame members have been braided through the netting marginal apertures and are spread apart sufficiently so that their adjacent ends can be inserted into the joining elbows 1 forming the corners of the frame, the netting will be stretched taut within the frame so as to support garments on it without appreciable sagging. The netting twine or cord is preferably made of material which does not absorb water readily, but which is strong, such as of nylon.

It may not always be convenient to support the platform by the legs 5, in which event the legs can be retracted into the positions shown in FIG. 2 and in solid lines in FIG. 1, generally coplanar with each other and with the frame. Additional supporting means which can be used alternatively to the legs include suction cups 8 mounted on the bottom of each elbow 1. By making the frame side marginal members 3 of a length to span the width of a bathtub, the platform can be supported with its opposite end marginal members 2 in registration with the opposite sides, respectively, of the bathtub while the suction cups 8 carried by side portions of the corners of the frame and projecting laterally beyond the frame, as shown in FIG. 1, can engage and grip the bathtub rim for supporting the platform stably slightly elevated from the bathtub rim, as shown in FIG. 4. Any dripping which may pass from a garment on the platform through the netting will then be caught in the bathtub.

Particularly for outdoor drying, it may be desirable to suspend the knitting platform, such as from a clothesline. For this purpose a suspension sling or bridle is shown in FIG. 3, composed of a suspension fitting in the form of ring 9 that may be placed over a hook and four leg cords 10 of equal length diverging downward from the ring 9 to the four corners respectively of the platform frame. As shown in FIG. 3, the downwardly extending legs of the sling are in the form of loops, the lower ends of which straddle the elbows 1 and are caught behind the suction cups 8 to anchor such loops to the platform corners. Each sling leg loop can be spread easily to span an elbow and pass over the suction cup beneath it so as to be caught behind the suction cup. The loop can be detached from the corner of the platform as readily simply by spreading it again, pulling it out from behind the suction cup and slipping it over the suction cup to release it from the platform corner.

I claim:

1. A rectangular platform for supporting a garment spread thereon to dry comprising a rectangular nonmetallic nonrigid netting panel having edge portions, a rectangular marginal frame having corners and including rigid side members connected to said netting panel edge portions, respectively, for stretching said nonmetallic nonrigid netting panel, at least two opposite ones of said side members being of a length to enable said netting panel to span a bathtub having opposite rims, suction cups on the same side of each corner of said frame, projecting laterally beyond said frame and engageable with the opposite rims of a bathtub for supporting said netting panel slightly elevated above the bathtub rims, and a suspension sling including a suspension fitting and four cord leg members diverging downward from said fitting, each cord leg member including a loop for straddling a corner of said frame and to be hooked behind said suction cup on such frame corner for attaching said cord leg member to that frame corner.

2. A rectangular platform for supporting a garment spread thereon to dry comprising a rectangular nonmetallic nonrigid coarse netting panel having apertures including marginal apertures therethrough, a rectangular marginal frame including straight rigid marginal members, each marginal member being of a width less than the widths of the netting panel mesh apertures and knitted through marginal apertures along the four sides of said netting panel, respectively, elbows connecting the adjacent ends of said marginal members at each corner of said rectangular frame for holding said marginal members in spread-apart relationship stretching said nonmetallic nonrigid netting panel between said marginal members, two hollow tee members at each of two opposite sides of said marginal frame, one of said marginal members extending through the through bore of each tee member, a leg connected to the lateral bore of each tee member for swinging therewith relative to the marginal frame member extending through the through bore of such tee member between retracted and extended positions, suction cups on corresponding sides of said elbows and projecting laterally beyond said frame for supporting the platform slightly elevated above surfaces engaged by said suction cups, and a suspension sling including a suspension fitting and four cord leg members diverging downward from said fitting, each cord leg member including a loop for straddling one of said elbows at a corner of said frame and to be hooked behind said suction cup on said elbow for attaching said cord leg member to said elbow.

3. A platform for supporting a garment spread thereon to dry comprising a rectangular nonmetallic, nonrigid netting panel having edge portions, a rectangular marginal frame including four straight rigid side members connected to said netting panel edge portions, respectively, elbow members connecting together adjacent ends of said adjacent side members for holding said side members in spread-apart relationship stretching said nonmetallic, nonrigid netting panel between said side members, two hollow tee members at each of two opposite sides of said marginal frame, one of said marginal members extending through the through bore of each tee member, and a leg connected to the lateral bore of each of said tee members for swinging therewith relative to the marginal frame member extending through the through bore of such tee member between retracted and extended positions.

* * * * *